US005579751A

United States Patent [19]

Lin

[11] Patent Number: 5,579,751

[45] Date of Patent: Dec. 3, 1996

[54] CATAPULT HAVING A DISENGAGABLE HANDLE

[76] Inventor: Chyun-Kwang Lin, 73-1 Sec. 3, Tungkwan Rd., Taiping Hsiang, Taiwan

[21] Appl. No.: 597,636

[22] Filed: Feb. 5, 1996

[51] Int. Cl.[6] ..... F41B 3/02

[52] U.S. Cl. ..... 124/20.1; 124/1; 124/180

[58] Field of Search ..... 124/1, 20.1, 20.2, 124/20.3, 25.6, 80; 403/321, 325, 326

[56] References Cited

U.S. PATENT DOCUMENTS

| | | | |
|---|---|---|---|
| 4,265,212 | 5/1981 | Wolf | 124/20.1 |
| 4,307,699 | 12/1981 | Cuesta | 124/80 X |
| 4,458,658 | 7/1984 | Blair | 124/20.1 |
| 4,957,093 | 9/1990 | Hamlett | 124/25.6 X |
| 5,282,453 | 2/1994 | Chia | 124/20.1 |

FOREIGN PATENT DOCUMENTS

| | | | |
|---|---|---|---|
| 672262 | 5/1952 | United Kingdom | 124/20.1 |
| 2262019 | 6/1993 | United Kingdom | 124/20.1 |

*Primary Examiner*—John A. Ricci
*Attorney, Agent, or Firm*—Charles E. Baxley, Esq.

[57] ABSTRACT

A catapult includes a handle having an opening formed in the upper portion for receiving a stud of a block. The stud has a projection extended forward for engaging with the handle. A bracket is secured to the block for supporting a resilient belt. A knob is engaged in the rear portion of the handle for engaging with the stud so as to retain the stud in the handle. The stud and thus the block may be easily disengaged from the handle by depressing the knob. An arm rest is secured to the block for preventing the bracket and the handle from rotating toward the user.

4 Claims, 4 Drawing Sheets

CATAPULT HAVING A DISENGAGABLE HANDLE

BACKGROUND OF THE INVENTION

1. Field of the Invention

The present invention relates to a catapult, and more particularly to a catapult having a disengagable handle.

2. Description of the Prior Art

Typical catapults comprise a handle having a U-shaped bracket provided thereon for engaging with a resilient belt. However, the handle is solidly secured to the bracket and may not be disengaged from the bracket such that the catapult comprises a large volume which can not be easily carried by the users.

The present invention has arisen to mitigate and/or obviate the afore-described disadvantages of the conventional catapults.

SUMMARY OF THE INVENTION

The primary objective of the present invention is to provide a catapult which includes a handle that may be easily disengaged from the bracket for storing and transportation purposes.

In accordance with one aspect of the invention, there is provided a catapult comprising a handle including an upper portion having an opening formed therein and including a front portion having an orifice formed therein and communicating with the opening, and including a rear portion having an aperture formed therein and communicating with the opening, a block including a stud extended downward therefrom for engaging with the opening of the handle, the stud including a projection extended forward therefrom for engaging with the orifice of the handle and including a rear portion, a bracket including a lower portion secured to the block and including an upper portion having a resilient belt secured thereto, and a knob means slidably engaged in the aperture of the handle for engaging with the rear portion of the stud so as to retain the stud in the handle.

The knob means includes a channel formed therein for engaging with the handle so as to allow the knob means to be moved upward and downward in the aperture, the knob means includes a protrusion extended therefrom for engaging with the rear portion of the stud, and the knob means further includes a biasing means engaged between the handle and the knob means for biasing the knob means upward and for engaging the protrusion with the notch.

An arm rest is secured to the block for engaging with an arm of a user and for preventing the bracket and the handle from rotating toward the user.

A plurality of knives and/or tools are further rotatably secured to the handle and received in the handle.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
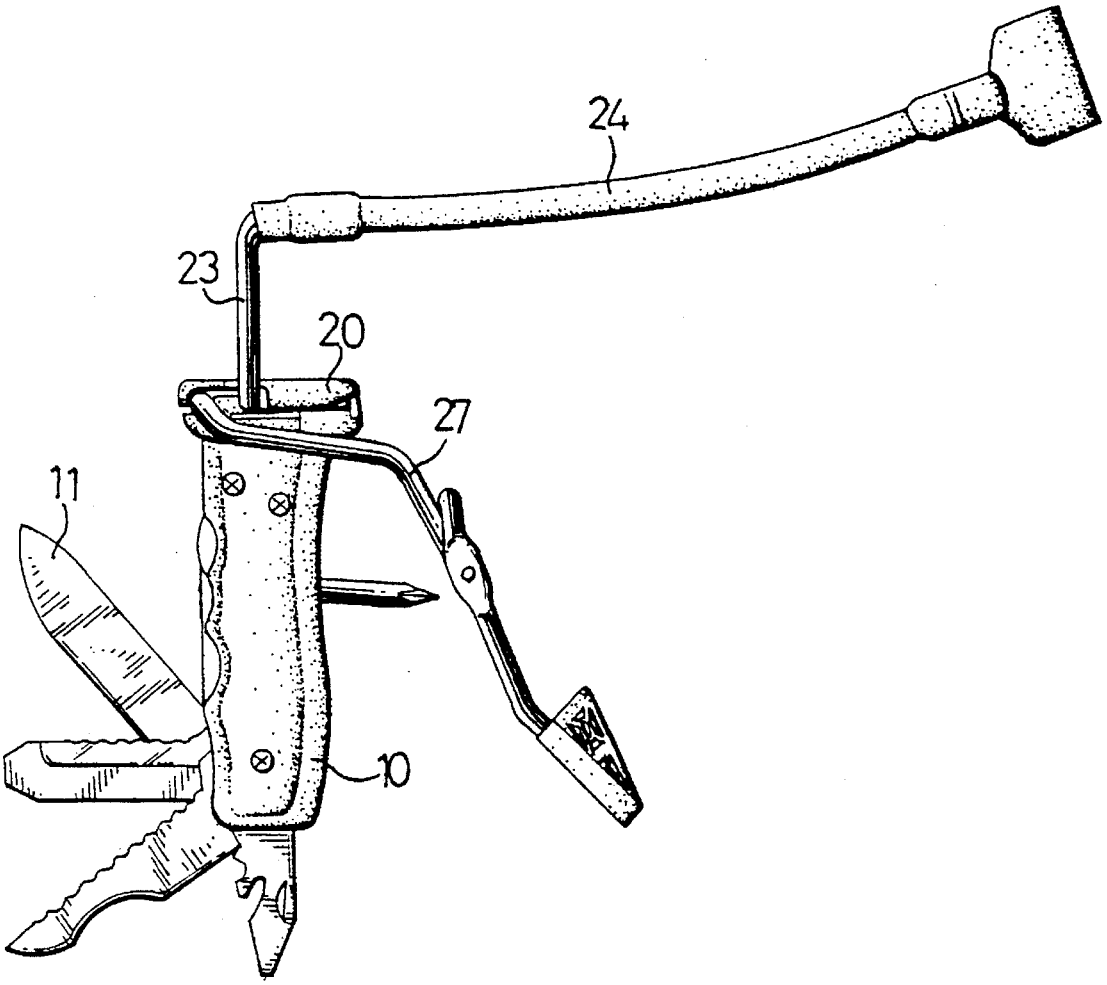
FIG. 1 is a side view of a catapult in accordance with the present invention.
Figure 2:
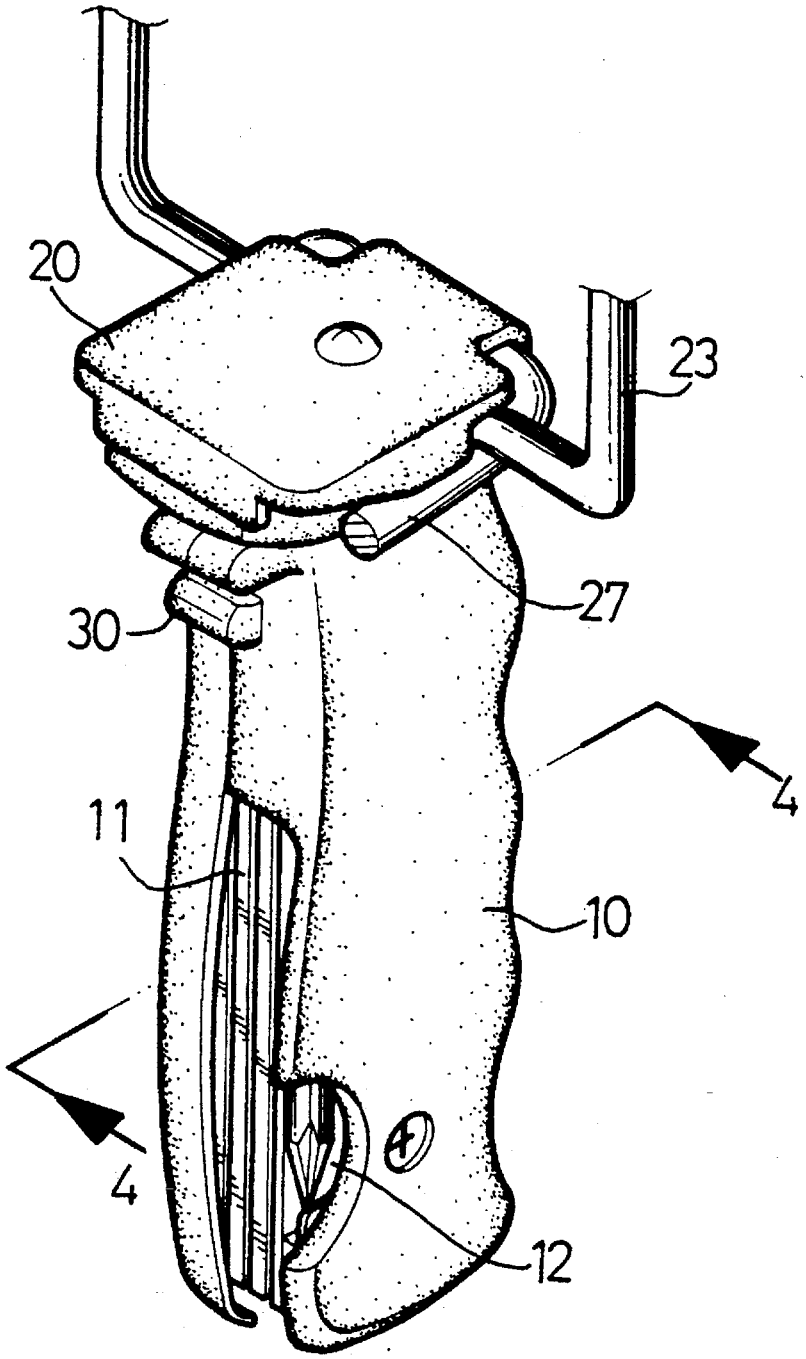
FIG. 2 is a partial perspective view of the catapult.
Figure 3:
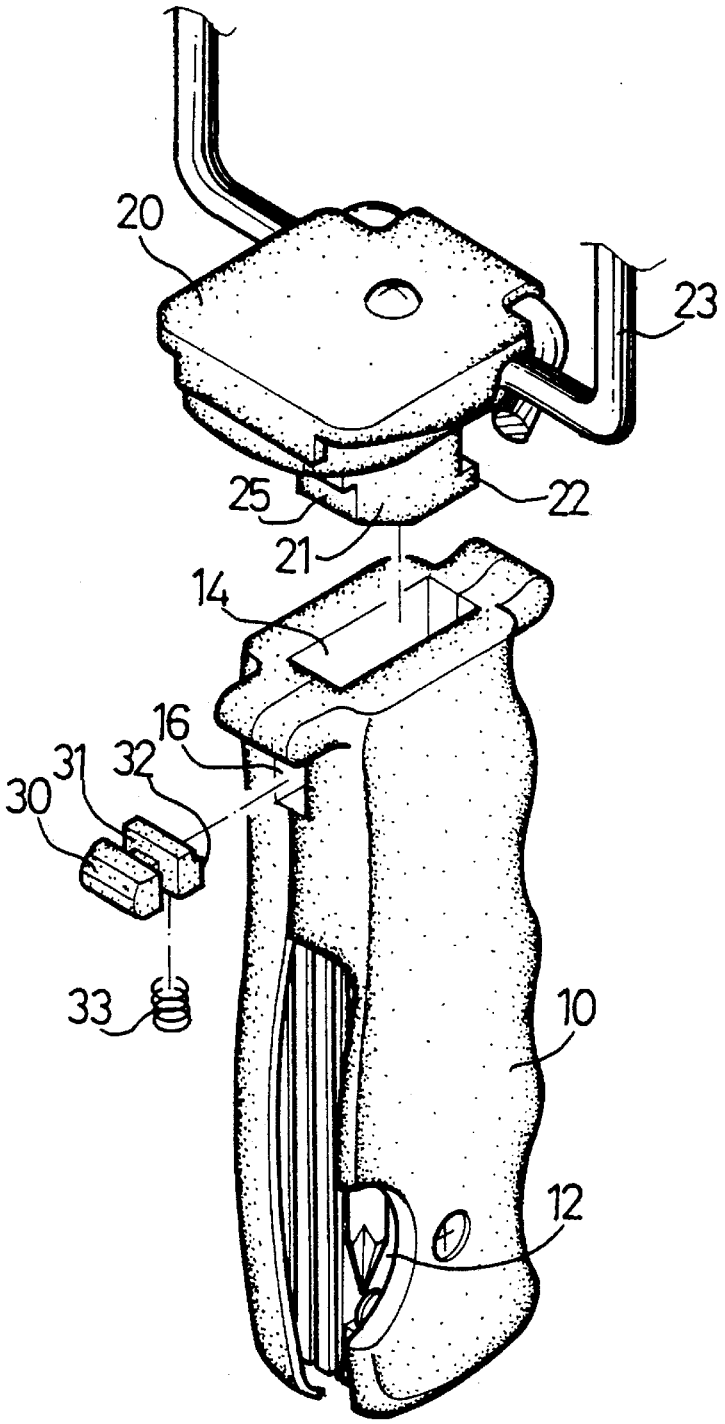
FIG. 3 is a partial exploded view of the catapult.

Referring to the drawings, a catapult in accordance with the present invention comprises a handle 10 including a number of knives and/or tools 11 rotatably secured therein and receivable in the hollow interior 12 thereof. The handle 10 includes an opening 14 formed in the upper portion and includes an orifice 15 formed in the front portion thereof and communicating with the opening 14, and includes an aperture 16 formed in the rear portion thereof and communicating with the opening 14.

A block 20 includes a stud 21 extended downward therefrom for engaging with the opening 14 of the handle and includes a projection 22 extended forward from the stud 21 for engaging with the orifice 15 of the handle 10. A U-shaped bracket has a lower portion secured in the block 20 and includes a resilient belt 24 secured to the upper portion. The stud 21 includes a notch 25 formed in the rear portion thereof. An arm rest 27 is secured to the block 20 for engaging with the arm of the user and is rotatable about the block 20. As shown in FIG. 1, when the resilient belt 24 is pulled rightward, the arm rest 27 may engage with the bottom portion of the bracket 23 so as to prevent the bracket 23 from rotating toward the user, i.e., rotating clockwise as viewing from FIG. 1.

A knob 30 is engaged in the aperture 16 of the handle 10 and includes a channel 31 formed therein for engaging with the handle 10 so as to allow the knob 30 to be moved upward and downward in the aperture 16. The knob 30 includes a protrusion 32 extended therefrom for engaging with the notch 25 of the stud 21. A spring 33 is engaged between the handle 10 and the knob 30 for biasing the knob 30 upward and for engaging the protrusion 32 with the notch 25.

Figure 4:
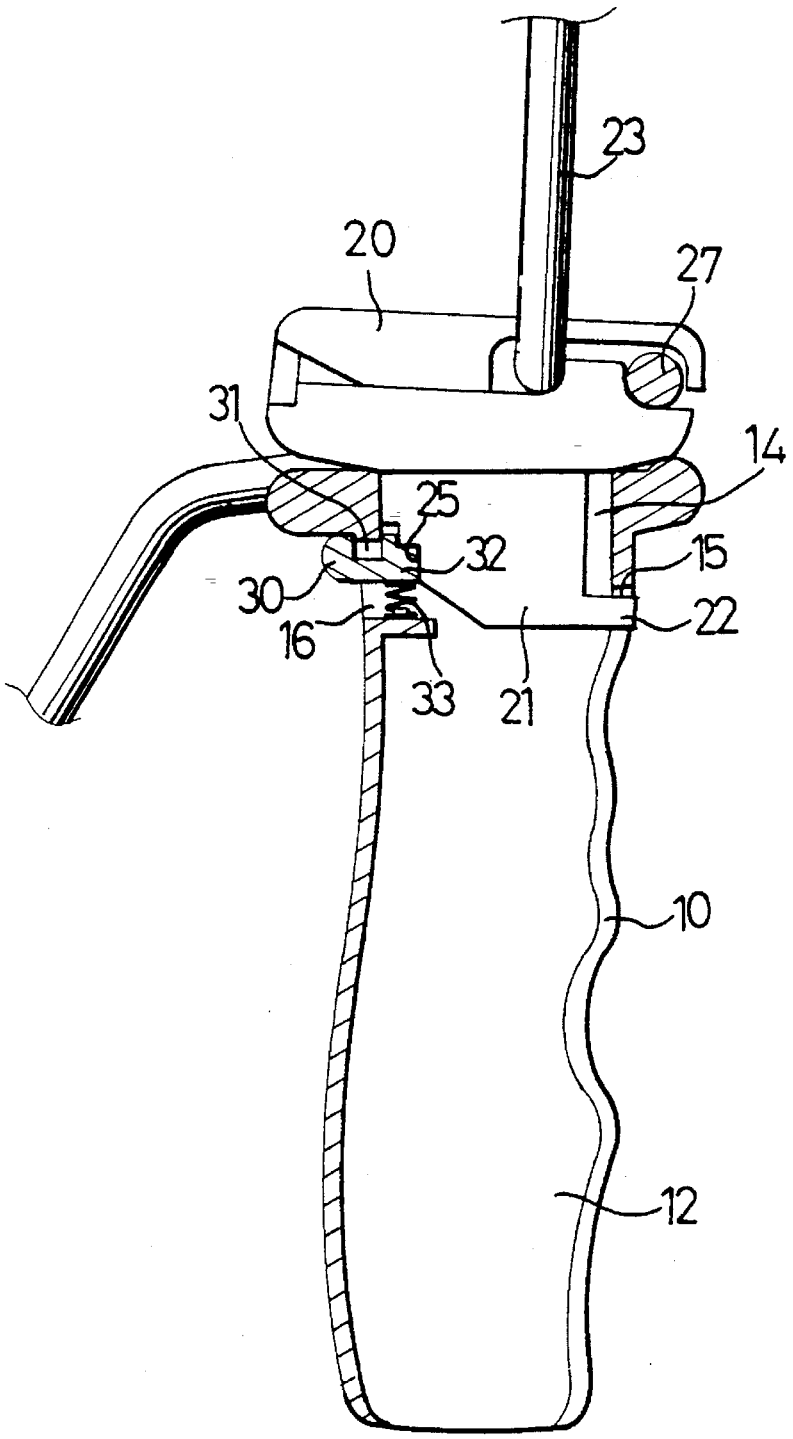
FIG. 4 is a cross sectional view taken along lines 4—4 of FIG. 2.

In assembling, as best shown in FIG. 4, the projection 22 of the stud 21 is first engaged in the orifice 15 of the handle 10. The block 20 is then rotated about the projection 22 so as to engage the stud 21 into the opening 14 of the handle 10. The knob 30 may be moved downward against the spring 33 by the stud 21 such that the protrusion 32 of the knob 30 may be engaged with the notch 25 and such that the stud 21 may be solidly secured to the handle 10. When it is required to disengage the stud 21 from the handle 10, it is only required to depress the knob 30 downward against the spring 33 in order to disengage the protrusion 32 from the notch 25 of the stud 21. The stud 21 may thus be rotated about the projection 22 and may be easily disengaged from the handle.

Accordingly, the catapult in accordance with the present invention includes a handle which may be easily disengaged from the bracket for transportation and for storing purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A catapult comprising:

a handle including an upper portion having an opening formed therein and including a front portion having an orifice formed therein and communicating with said opening, and including a rear portion having an aperture formed therein and communicating with said opening, a block including a stud extended downward therefrom for engaging with said opening of said handle, said stud including a projection extended forward therefrom for engaging with said orifice of said handle and including a rear portion, a bracket including a lower portion secured to said block and including an upper portion having a resilient belt secured thereto, and a knob means slidably engaged in said aperture of said handle for engaging with said rear portion of said stud so as to retain said stud in said handle.

2. A catapult according to claim 1, wherein said knob means includes a channel formed therein for engaging with said handle so as to allow said knob means to be moved upward and downward in said aperture, said knob means includes a protrusion extended therefrom for engaging with said rear portion of said stud, and said knob means further includes a biasing means engaged between said handle and said knob means for biasing said knob means upward and for engaging said protrusion with said rear portion of said stud.

3. A catapult according to claim 1 further comprising an arm rest secured to said block for engaging with an arm of a user and for preventing said bracket and said handle from rotating toward the user.

4. A catapult according to claim 1 further comprising a plurality of knives rotatably secured to said handle and received in said handle.

* * * * *